US008930186B2

(12) United States Patent
Hetherington et al.

(10) Patent No.: US 8,930,186 B2
(45) Date of Patent: Jan. 6, 2015

(54) SPEECH ENHANCEMENT WITH MINIMUM GATING

(71) Applicant: QNX Software Systems Limited, Kanata, Ontario (CA)

(72) Inventors: Phillip A. Hetherington, Port Moody (CA); Shreyas Paranjpe, Vancouver (CA); Xueman Li, Burnaby (CA)

(73) Assignee: 2236008 Ontario Inc., Waterloo, Ontario (CA)

( * ) Notice: Subject to any disclaimer, the term of this patent is extended or adjusted under 35 U.S.C. 154(b) by 149 days.

(21) Appl. No.: 13/676,463

(22) Filed: Nov. 14, 2012

(65) Prior Publication Data

US 2013/0080158 A1 Mar. 28, 2013

Related U.S. Application Data

(63) Continuation of application No. 12/454,841, filed on May 22, 2009, now Pat. No. 8,326,617, and a continuation-in-part of application No. 11/923,358, filed on Oct. 24, 2007, now Pat. No. 8,015,002, and a continuation-in-part of application No. 12/126,682, filed on May 23, 2008, now Pat. No. 8,606,566.

(60) Provisional application No. 61/055,949, filed on May 23, 2008.

(51) Int. Cl.

| | |
|---|---|
| ***G10L 21/02*** | (2013.01) |
| ***G10L 21/00*** | (2013.01) |
| ***G10L 21/0208*** | (2013.01) |
| ***G10L 19/012*** | (2013.01) |
| ***G10L 19/26*** | (2013.01) |

(52) U.S. Cl.
CPC ..... *G10L 21/0208* (2013.01); *G10L 19/012* (2013.01); *G10L 19/26* (2013.01)
USPC ..... 704/227; 704/226; 704/201

(58) Field of Classification Search
USPC ..... 704/200–275, 500–504
See application file for complete search history.

(56) References Cited

U.S. PATENT DOCUMENTS

| | | | |
|---|---|---|---|
| 4,853,963 | A | 8/1989 | Bloy et al. |
| 5,408,580 | A | 4/1995 | Stautner et al. |

(Continued)

FOREIGN PATENT DOCUMENTS

| | | |
|---|---|---|
| EP | 1 450 354 A1 | 8/2004 |
| JP | 2000-347688 | 12/2000 |

(Continued)

OTHER PUBLICATIONS

Linhard, Klaus etal., "Spectral Noise Subtraction with Recursive Gain Curves," *Daimler Benz AG, Research and Technology*, Jan. 9, 1998, 4 pages.

(Continued)

*Primary Examiner* — Jesse Pullias
(74) *Attorney, Agent, or Firm* — Brinks Gilson & Lione

(57) ABSTRACT

A speech enhancement system enhances transitions between speech and non-speech segments. The system includes a background noise estimator that approximates the magnitude of a background noise of an input signal that includes a speech and a non-speech segment. A slave processor is programmed to perform the specialized task of modifying a spectral tilt of the input signal to match a plurality of expected spectral shapes selected by a Codec.

17 Claims, 7 Drawing Sheets

(56) References Cited

U.S. PATENT DOCUMENTS

| | | | | |
|---|---|---|---|---|
| 5,414,796 | A | 5/1995 | Jacobs et al. | |
| 5,701,393 | A | 12/1997 | Smith et al. | |
| 5,978,783 | A | 11/1999 | Meyers et al. | |
| 5,978,824 | A | 11/1999 | Ikeda | |
| 6,044,068 | A | 3/2000 | El Malki | |
| 6,144,937 | A | 11/2000 | Ali | |
| 6,163,608 | A | 12/2000 | Romesburg et al. | |
| 6,263,307 | B1 | 7/2001 | Arslan et al. | |
| 6,336,092 | B1 | 1/2002 | Gibson et al. | |
| 6,493,338 | B1 | 12/2002 | Preston et al. | |
| 6,493,664 | B1 * | 12/2002 | Udaya Bhaskar et al. | 704/222 |
| 6,526,376 | B1 * | 2/2003 | Villette et al. | 704/207 |
| 6,570,444 | B2 | 5/2003 | Wright | |
| 6,690,681 | B1 | 2/2004 | Preston et al. | |
| 6,741,874 | B1 | 5/2004 | Novorita et al. | |
| 6,771,629 | B1 | 8/2004 | Preston et al. | |
| 6,862,558 | B2 | 3/2005 | Huang | |
| 7,072,831 | B1 | 7/2006 | Etter | |
| 7,142,533 | B2 | 11/2006 | Ghobrial et al. | |
| 7,146,324 | B2 | 12/2006 | Den Brinker et al. | |
| 7,366,161 | B2 | 4/2008 | Mitchell et al. | |
| 7,580,893 | B1 | 8/2009 | Suzuki | |
| 7,716,046 | B2 | 5/2010 | Nongpiur et al. | |
| 7,792,680 | B2 | 9/2010 | Iser et al. | |
| 8,015,002 | B2 | 9/2011 | Li et al. | |
| 2001/0006511 | A1 | 7/2001 | Matt | |
| 2001/0018650 | A1 | 8/2001 | DeJaco | |
| 2001/0054974 | A1 | 12/2001 | Wright | |
| 2003/0050767 | A1 | 3/2003 | Bar-Or | |
| 2003/0055646 | A1 * | 3/2003 | Yoshioka et al. | 704/258 |
| 2003/0093278 | A1 * | 5/2003 | Malah | 704/265 |
| 2004/0019492 | A1 * | 1/2004 | Tucker et al. | 704/500 |
| 2004/0066940 | A1 | 4/2004 | Amir | |
| 2004/0153313 | A1 | 8/2004 | Aubauer et al. | |
| 2004/0167777 | A1 | 8/2004 | Hetherington et al. | |
| 2005/0065792 | A1 | 3/2005 | Gao | |
| 2005/0119882 | A1 | 6/2005 | Bou-Ghazale | |
| 2006/0100868 | A1 | 5/2006 | Hetherington et al. | |
| 2006/0136203 | A1 | 6/2006 | Ichikawa | |
| 2006/0142999 | A1 | 6/2006 | Takada et al. | |
| 2006/0293016 | A1 | 12/2006 | Giesbrecht et al. | |
| 2007/0025281 | A1 | 2/2007 | McFarland et al. | |
| 2007/0058822 | A1 | 3/2007 | Ozawa | |
| 2007/0185711 | A1 | 8/2007 | Jang et al. | |
| 2007/0237271 | A1 | 10/2007 | Pessoa et al. | |
| 2008/0077399 | A1 | 3/2008 | Yoshida | |
| 2008/0120117 | A1 | 5/2008 | Choo et al. | |
| 2008/0262849 | A1 | 10/2008 | Buck et al. | |
| 2009/0112579 | A1 | 4/2009 | Li et al. | |
| 2009/0112584 | A1 | 4/2009 | Li et al. | |
| 2009/0216527 | A1 | 8/2009 | Oshikiri | |

FOREIGN PATENT DOCUMENTS

| | | |
|---|---|---|
| JP | 2002-171225 | 6/2002 |
| JP | 2002-221988 | 8/2002 |
| JP | 2004-254322 | 9/2004 |
| WO | WO 01/73760 A1 | 10/2001 |

OTHER PUBLICATIONS

Ephraim, Y. et al., "Speech Enhancement Using a Minimum Mean-Square Error Log-Spectral Amplitude Estimator," *IEEE Transactions on Acoustic, Speech, and Signal Processing*, vol. ASSP-33, No. 2, Apr. 1985, pp. 443-445.

Ephraim, Yariv et al., "Speech Enhancement Using a Minimum Mean-Square Error Short-Time Spectral Amplitude Estimator," *IEEE Transactions on Acoustics Speech, and Signal Processing*, vol. ASSP-32, No. 6, Dec. 1984, pp. 1109-1121.

Martinez et al.; "Combination of adaptive filtering and spectral subtraction for noise removal"; Circuits and Systems, 2001; ISCAS 2001; pp. 793-796, vol. 2.

* cited by examiner

SPEECH ENHANCEMENT WITH MINIMUM GATING

PRIORITY CLAIM

This application is a continuation of U.S. patent application Ser. No. 12/454,841, entitled "Speech Enhancement with Minimum Gating," filed May 22, 2009, which is a continuation-in-part of U.S. patent application Ser. No. 11/923,358, entitled "Dynamic Noise Reduction," filed Oct. 24, 2007, and U.S. patent application Ser. No. 12/126,682, entitled "Speech Enhancement Through Partial Speech Reconstruction," filed May, 23, 2008, and claims the benefit of priority from U.S. Provisional Application No. 61/055,949, entitled "Minimization of Speech Codec Noise Gating," which are all incorporated by reference.

BACKGROUND OF THE INVENTION

1. Technical Field

This disclosure relates to communication systems, and more specifically to communication systems that mediates gating.

2. Related Art

In telecommunication systems, entire speech and noise segments may not pass through a speech enhancement system. Prior to digital transmissions, the noisy speech may be encoded by the speech codec. At a high level, when speech lulls are detected a codec may transmit comfort noise. To select a noise segment, the spectral shape of the input signal may be compared against spectral entries retained in a lookup table.

Spectral entries may be derived from samples of clean speech in a low noise environment. In high noise environments, an input may not resemble stored entry. This may occur when a spectral tilt is greater than an expected spectral tilt.

SUMMARY

A speech enhancement system enhances transitions between speech and non-speech segments. The system includes a background noise estimator that approximates the magnitude of a background noise of an input signal that includes a speech and a non-speech segment. A slave processor is programmed to perform the specialized task of modifying a spectral tilt of the input signal to match a plurality of expected spectral shapes selected by a Codec.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
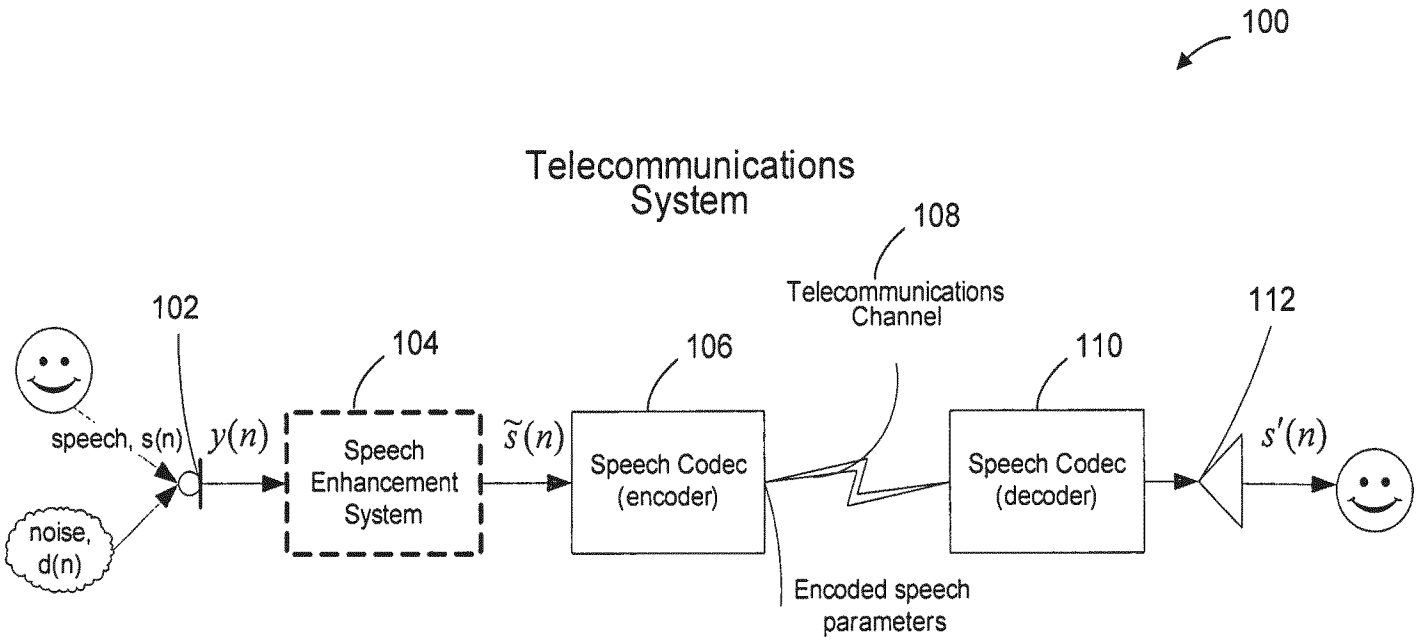
FIG. 1 is an exemplary telecommunication system.

The transmission and reception of information may be conveyed through electrical or optical wavelengths transmitted through a physical or a wireless medium. Speech and noise may be received by one or more devices that convert sound into analog signals or digital data. In the telecommunication system 100 of FIG. 1, speech and noise are converted by one or more microphones 102 that deliver the spectrum to a speech enhancement system 104. Prior to transmission, a Codec 106 such as an Enhanced Variable Rate Codec (EVRC), an Enhanced Variable rate Codec Wideband Extension (EVRC-WB), or an Enhanced Variable Rate Codec-B (EVRC-B), for example, may compress segments of the spectrum into frames (e.g., full rate, half rate, quarter rate, eighth rate) using a fixed or a variable rate coding. In some applications, a frame may represent a background noise. When comfort noise is selected for transmission of a noise segment, the spectral shape of the input signal may be compared against the spectral shapes retained in a lookup table. In some systems, a slave processor (not shown) may perform the specialized task of providing rapid access to a database or memory retaining the spectral entries of the lookup table, freeing the Codec for other work. When the closest matching spectrum of a constrained set is identified it may be selected by the slave processor and transmitted by the Codec 106 through a wireless or wired medium 108. Through the software and hardware that comprises the de-compressor (e.g., speech Codec 110), the transmitted information may be converted into electrical and/or optical output (e.g., an audio or aural signal), that is converted (or transformed) into audible or aural sound through a loudspeaker 112.

In some telecommunication systems a user on a far side of a conversation may hear noise in the low frequencies when the near-side person is talking, but may not hear that noise when the person stops talking (disrupting the natural transition between a speech and non-speech segment). Noise transmitted during speech may also become correlated with speech, further degrading a perceived or subjective speech quality by making a speech segment sound rough or coarse. This phenomenon may occur in hands-free communication systems that may receive or place calls from vehicles, such as vehicles traveling on highways. The interference may be noticeable in vehicles with mid-engine mounts.

Some telecommunication systems may mitigate the interference through noise removal. While some noise removal systems may reduce the magnitude of the interference, the telecommunication systems may not eliminate it or dampen the affect to a desired level. In some hands-free systems, it may be undesirable to reduce the noise by more than a predetermined level (e.g., about 10 dB to about 12 dB) to minimize changes in speech quality. In the lower frequencies, noise may be substantial and require more noise removal than is desired to reduce gating effects.

To reduce the noticeable effects of gating, some systems ensure that residual noise generated by the speech enhancement system is consistent with a comfort noise range generated by Codecs. In these telecommunication systems, a residual noise may comprise the noise that remains after performing noise removal on an input or noisy signal. The residual noise level and its color (e.g., spectral shape) comprise characteristics that may determine when the output signal of a speech enhancement system may be susceptible to gating such as speech codec gating on a CDMA network.

Some systems that eliminate or minimize noise may render good speech quality when the noise suppression reduces the background noise by a predetermined level (e.g., about 10 dB to about 12 dB.) Speech quality may suffer when background noise is suppressed by an attenuation level exceeding an upper limit (e.g., more than about 15 dB). However, for many applications, such as in-vehicle hands-free communication systems, suppressing noise by a predetermined level may not render good speech quality and the residual noise may cause noise gating that may be heard by far-side talkers. Some noise suppression may cause speech distortion and generate musical tones.

Controlling the residual noise color (e.g., spectral shape) may prevent some noise gating. Some Codecs such as the EVRC, EVRC-WB, and EVRC-B, for example, may support only a limited number of spectral shapes to encode a background noise. The retained spectral shapes may be constrained by the spectral tilts that may not match the noise color detected in vehicle or other environments. Some speech enhancement systems may control noise gating by monitoring and modifying the spectral tilt of an input signal to render a better match with the Codec's retained spectral shapes. Rather than applying a maximum attenuation level across a wide frequency range, some speech enhancement systems prevent gating (e.g., Code Division Multiple Access gating) by applying variable or dynamically changing attenuation levels at different frequencies or frequency ranges that may include an adaptive gain floor. Dynamic noise reduction techniques such as the systems and methods disclosed in U.S. Ser. No. 11/923,358, entitled Dynamic Noise Reduction, filed Oct. 24, 2007, which is incorporated by reference, may precondition the input signals.

Figure 2:
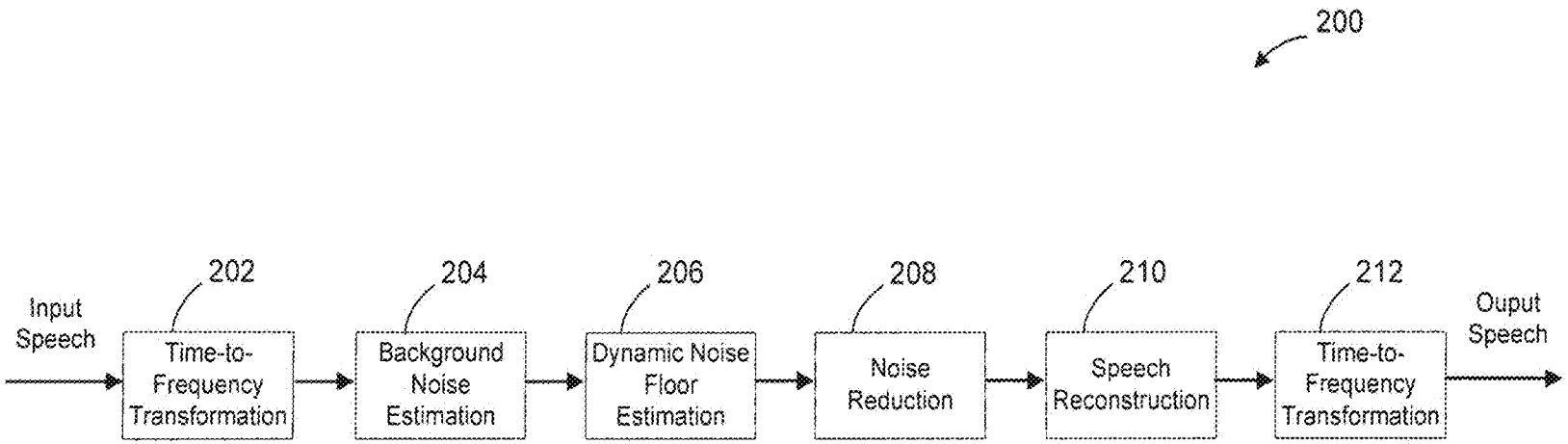
FIG. 2 is an exemplary speech enhancement system.

FIG. 2 is a block diagram of an alternative speech enhancement system 200. In FIG. 2 a time-to-frequency converter 202 converts a time domain speech signal into frequency domain through a short-time Fourier transformation (STFT) and/or sub-band filters. The signal power may be measured or estimated for each frequency bin or sub-band, and background noise may be estimated through a noise estimator 204. In some speech enhancement systems, noise may be estimated or measured through the systems and methods disclosed in Ser. No. 11/644,414, entitled "Robust Noise Estimation" filed Dec. 22, 2006, which is incorporated by reference. With the background noise measured or estimated, a dynamic noise floor may be established through a dynamic noise controller 206. In some speech enhancement systems, the dynamic noise floor may be established through systems and methods described in Ser. No. 11/923,358, entitled "Dynamic Noise Reduction," filed Oct. 24, 2007, which is incorporated by reference. A noise suppressor (or attenuator) 208 may apply an aggressive noise reduction that may suppress noise levels and modify the background noise color (e.g., spectral structure). To improve speech quality when processed by a Codec, a speech reconstruction controller 210 may reconstruct some or all of the low-frequency harmonics. In some speech enhancement systems, speech may be reconstructed through the systems and methods disclosed in Ser. No. 12/126,682, entitled "Speech Enhancement Through Partial Speech Reconstruction" filed May 23, 2008, which is incorporated by reference. The frequency domain signal may be transformed into the time domain through a time-to-frequency converter 212. Some time-to-frequency converters 212 convert the frequency domain speech signal into a time domain signal through a short-time inverse Fourier transformation or sub-band inverse filtering.

In some speech enhancement systems, noisy speech may be expressed by Equation 1

$$y(t)=x(t)+d(t) \tag{1}$$

where x(t) and d(t) denote the speech and the noise signal, respectively.

$|Y_{n,k}|$, $|X_{n,k}|$, and $|D_{n,k}|$ may designate the short-time spectral magnitudes of noisy speech, clean speech, and noise at the nth frame and the kth frequency bin. In this enhancement system 200, the noise suppressor may apply a spectral gain factor $G_{n,k}$ to each short-time spectrum value. The estimated clean speech spectral magnitude may be expressed by Equation 2.

$$|\hat{X}_{n,k}|=G_{n,k}\cdot|Y_{n,k}| \tag{2}$$

In Equation 2, $G_{n,k}$ comprises the spectral suppression gain.

To eliminate or mask the musical noise that may occur when attenuating spectrum, the spectral suppression gain may be constrained by an adaptive floor or alternatively by a fixed floor (e.g., not allowed to decrease below a minimum value, σ). When based on a fixed floor, the spectral suppression gain may be expressed by Equation 3.

$$G_{n,k}=\max(\sigma,G_{n,k}) \tag{3}$$

In Equation 3, σ comprises a constant that establishes the minimum gain value, or correspondingly the maximum amount of noise attenuation in each frequency bin. For example, when σ is programmed or configured to about 0.3, the system's maximum noise attenuation may be limited to about 20 log 0.3 or about 10 dB at frequency bin k.

When the time domain speech signal is buffered in a local or remote database or memory and transformed into the frequency domain by the time-to-frequency converter 202, background noise may be measured or estimated by the noise estimator 204 and a dynamic noise floor established by the dynamic noise controller 206. An exemplary dynamic noise controller 206 may comprise a back-end (or slave) processor that performs the specialized task of establishing an adaptive (or dynamic) noise floor. Such a task may be considered "back-end" because some exemplary dynamic noise controller 206 may be subordinate to the operation of a Codec. Other exemplary dynamic noise controllers 206 are not subordinate to the operation of a Codec. An exemplary dynamic noise controller 206 may comprise the systems or methods disclosed in Ser. No. 11/923,358, entitled "Dynamic Noise Reduction" filed Oct. 24, 2007, variations thereof, and other systems.

Some dynamic noise controllers 206 estimate the background noise power $B_n$ at the nth frame that may be converted into dB domain through Equation 4.

$$\phi_n=10\log_{10}B_n. \tag{4}$$

An exemplary average dB power at low frequency range $b_L$ around an exemplary low frequency (e.g., about 300 Hz) and the average dB power at an exemplary high frequency range $b_H$ around a high frequency (e.g., about 3400) may be measured or derived.

The dynamic suppression factor for a given frequency below the cutoff frequency $f_o$ ($k_o$ bin) may be established by Equation 5.

$$\lambda(f) = \begin{cases} 10^{0.05*MAX((b_H-b_L+C),0)*(f_o-f)/f_o}, & \text{if } b_H + C < b_L \\ 1, & \text{otherwise} \end{cases} \quad (5)$$

Alternatively, for each bin below the cutoff frequency bin $k_o$, the dynamic suppression factor may be expressed by Equation 6.

$$\lambda(k) = \begin{cases} 10^{0.05*MAX((b_H-b_L+C),0)*(k_o-k)/k_o}, & \text{if } b_H + C < b_L \\ 1, & \text{otherwise} \end{cases} \quad (6)$$

In some exemplary speech enhancement systems 200, C comprises a constant between about 15 to about 25, which limits the maximum dB power difference between low frequencies and high frequencies of a residual noise.

The cutoff frequency $f_o$ may be selected or established based on the application. For example, it may be chosen to lie between about 1000 Hz to about 2000 Hz. Above the cutoff frequency, the dynamic suppression factor, λ, may be established as 1 (or about 1), to ensure a constant attenuation floor may be applied. Below a cutoff frequency, λ may comprise less than 1, which allows the minimum gain value, η, to be smaller than σ. In some applications, the maximum attenuation at lower frequencies may be greater than at higher frequencies.

As shown by Equation 7, the dynamic noise controller may establish a dynamic (or adaptive) noise floor based on frequency ranges or bin positions.

$$\eta(k) = \begin{cases} \sigma * \lambda(k), & \text{when } k < k_o \\ \sigma, & \text{when } k \geq k_o \end{cases} \quad (7)$$

By combining the dynamic floor with a spectral suppression, the speech enhancement system may maintain the spectral tilt of the residual noise within a certain range. More aggressive noise suppression may be imposed on low frequencies when an input noise tilt surpasses the maximum tilt limitation. The maximum tilt limitation may be based on an actual (or estimated) spectral shape selected by the codec. Through this enhancement a maximum tilt may be based on a Codec's allowable spectral shapes.

A digital signal processor such as an exemplary Weiner filter whose frequency response may be based on the signal-to-noise ratios may be modified in view of the speech enhancement. An unmodified suppression gain of the Weiner filter is described in Equation 8.

$$G_{n,k} = \frac{S\hat{N}R_{priori_{n,k}}}{S\hat{N}R_{priori_{n,k}} + 1}. \quad (8)$$

In FIG. 8, $S\hat{N}R_{prior_{n,k}}$ may comprise the a priori SNR estimate that may be derived recursively by Equation 9.

$$S\hat{N}R_{prior_{n,k}} = G_{n-1,k} S\hat{N}R_{post_{n,k}} - 1. \quad (9)$$

$S\hat{N}R_{post_{n,k}}$ may comprise a posteriori SNR estimate established by Equation 10.

$$S\hat{N}R_{post_{n,k}} = \frac{|Y_{n,k}|^2}{|\hat{D}_{n,k}|^2}. \quad (10)$$

In Equation 10, $|\hat{D}_{n,k}|$ comprises the noise estimate. The recursive gain may be expressed by Equation 11

$$G_{n,k} = 1 - \frac{1}{G_{n-1,k} S\hat{N}R_{post_{n,k}}} \quad (11)$$

The final gain is floored $$G_{n,k} = \max(\sigma, G_{n,k}). \quad (12)$$

Figure 3:
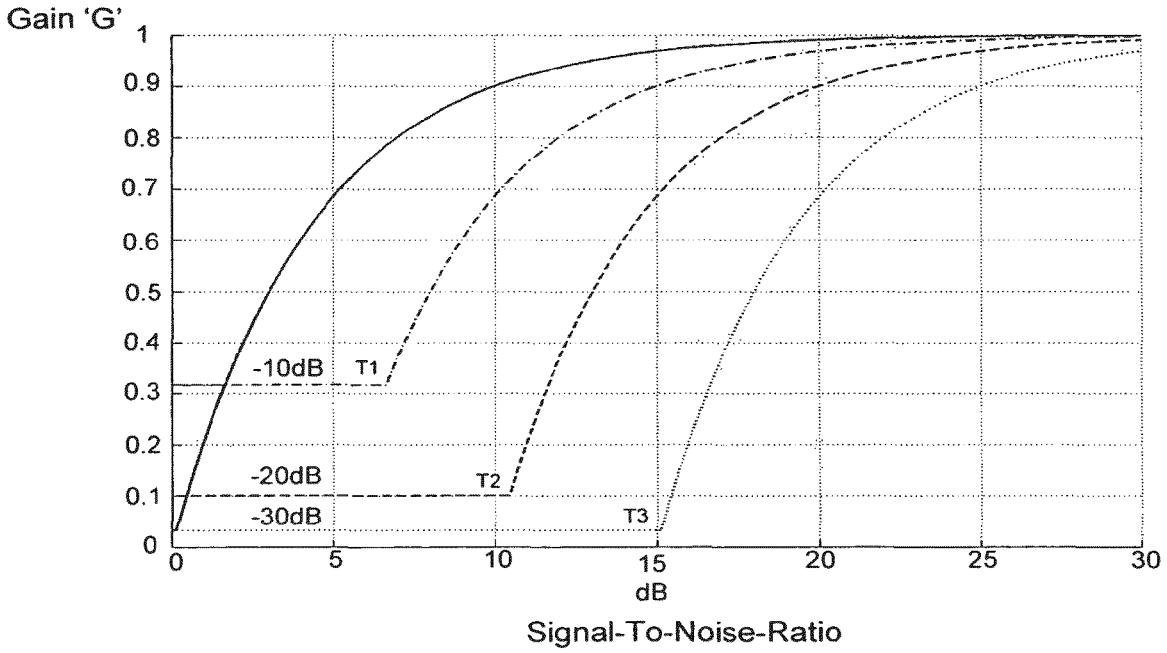
FIG. 3 is an exemplary recursive gain curve.

FIG. 3 shows the recursive gain curves of the above filter when performing at about a 10 dB, about a 20 dB, and about a 30 dB of noise suppression. As the maximum amount of noise suppression increases in FIG. 3, the activation threshold increases. For example, when the filter applies about 10 dB of noise suppression, the minimum SNR required to activate the filter may be around about 6.5 dB (T1). When applying about 20 dB of noise suppression, a minimum SNR of about 10.5 dB (T2) is required to activate the filter. For about 30 dB of noise suppression, a minimum SNR of about 15 dB (T3) is required.

As the maximum amount of attenuation increases and the filter activation threshold increases, low level SNR speech signals may be substantially rejected or attenuated. Additionally, the relatively gently sloping attenuation curves to the right of the activation thresholds may cause weak and/or delayed response during speech onsets. To overcome these conditions, the Wiener filter may be constrained.

By constraining the filter activation threshold to be a nearly constant level, a constrained recursive Weiner filter may preserve the natural transitions between a speech and a non-speech segment.

The gain function of the constrained recursive Wiener filter may be described by Equation 13.

$$G_{n,k} = 1 - \frac{1}{1 + G_{n-1,k}\left(S\hat{N}R_{post_{n,k}} - \beta(1 - G_{n-1,k}) - 1\right)}. \quad (13)$$

In Equation 13, β may comprise the ratio shown in Equation 14.

$$\beta = \frac{\xi\eta(k)}{G_{n-1,k}}, \quad (14)$$

In Equation 14, parameter ξ may comprise a constant in the range of about 0-5.

The adaptive or dynamic gain may be limited by the floor expressed in Equation 15.

$$G_{n,k} = \max(\eta(k), G_{n,k}). \quad (15)$$

Figure 4:
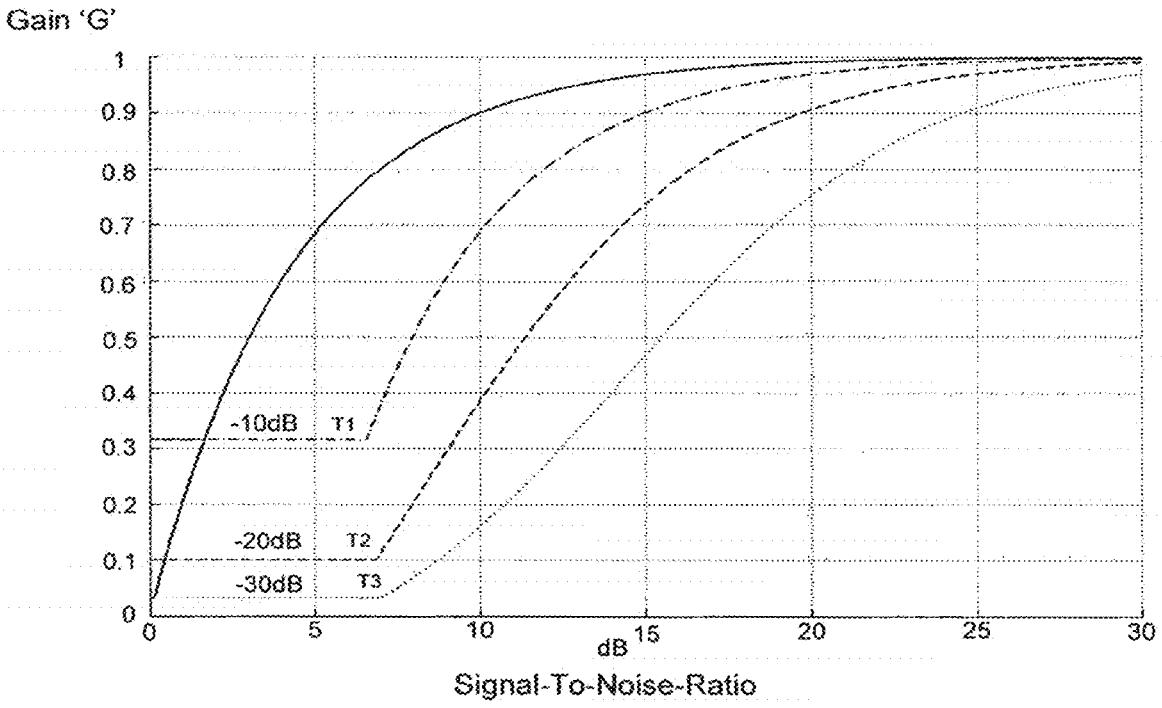
FIG. 4 is a second exemplary recursive gain curve.

FIG. 4 shows the gain curves of the constrained recursive filter when the filter applies about 10 dB, about 20 dB, and about 30 dB of noise suppression. An exemplary constant ξ is programmed or configured to about 3. Unlike other recursive filters that have a variable activation threshold that increases quickly when the maximum amount of noise suppression increases, this filter includes a reasonably fixed activation threshold that only varies slightly when the amount of maximum noise removal increases. FIG. 4 illustrates that the activation thresholds T1, T2, and T3 are within a small range between about 6 to 7 dB To enhance the performance of the noise reduction process, the multiplicative gain may be estimated in a two step process. Through this streamlined process, delays are reduced that may causes bias in the gain estimation and degrade the performance of the noise suppression.

In a $1^{st}$ step, a multiplicative gain $R_{n,k}$ may be estimated using the constrained recursive Wiener filter described by Equation 13.

$$R_{n,k} = 1 - \frac{1}{1 + G_{n-1,k}\left(S\overline{N}R_{post_ave_{n,k}} - \beta(1 - G_{n-1,k}) - 1\right)} \tag{16}$$

In Equation 13 β is described by the ratio of Equation 14.

$$\beta = \frac{\xi\eta(k)}{G_{n-1,k}}, \tag{14}$$

Conditional temporal smoothing may be applied to the SNR estimation though Equation 17.

$$S\overline{N}R_{post_ave_{n,k}} = \begin{cases} \alpha SNR_{post_ave_{n-1,k}} + (1-\alpha)S\hat{N}R_{post_{n,k}}, & \text{when } S\hat{N}R_{post_{n,k}} > SNR_{post_ave_{n-1,k}} \\ S\hat{N}R_{post_{n,k}}, & \text{else} \end{cases} \tag{17}$$

In Equation 17, a comprises a smoothing factor in the range between about 0.1 to about 0.9 that may be based on the frame shift of the system, and also the frequency range when applying smoothing.

The multiplicative gain obtained in the $1^{st}$ step may then be processed as an over-estimation factor to derive the final gain $G_{n,k}$ in the $2^{nd}$ step described by Equation 18.

$$G_{n,k} = 1 - \frac{1}{1 + R_{n,k}\left(S\hat{N}R_{post_{n,k}} - \beta(1 - R_{n,k}) - 1\right)} \tag{18}$$

In Equation 18 β comprises the ratio described in Equation 19.

$$\beta = \frac{\xi\eta(k)}{R_{n,k}}. \tag{19}$$

Figure 5:
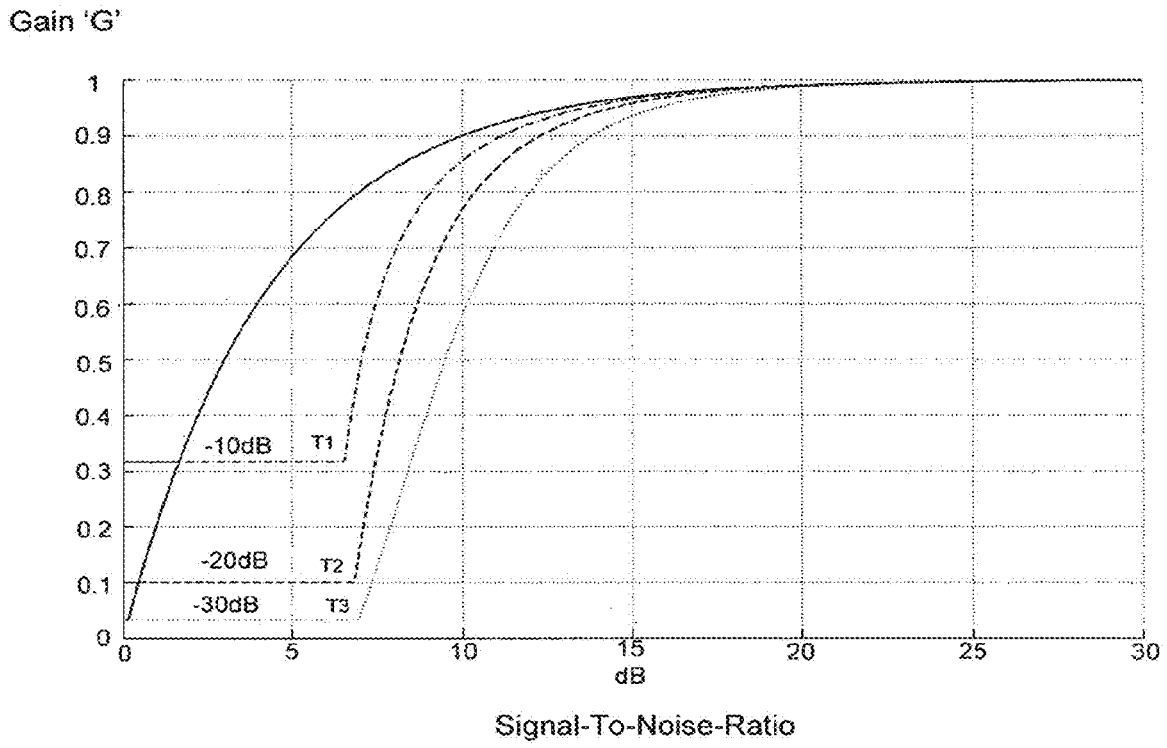
FIG. 5 is a third exemplary recursive gain curve.

FIG. 5 shows the gain curves of the two-step constrained recursive filter when it applies about 10 dB, about 20 dB, and about 30 dB of noise suppression. The constant ξ in FIG. 5 comprises about 3. From the steeper attenuation curves to the right of the activation threshold, FIG. 5 shows the two-step constrained recursive Wiener filter has a faster response during speech onset while maintaining the activation threshold in a small range.

Variations to the speech enhancement systems are applied in alternative systems. In some alternative systems performing more than 10 dB of noise reduction in lower frequencies may not be desirable unless a speech reconstruction is performed to reconstruct weak speech. The alternative speech enhancement systems may include reconstructions such as the systems and methods described in Ser. No. 60/555,582, entitled "Isolating Voice Signals Utilizing Neural Networks" filed Mar. 23, 2004; Ser. No. 11/085,825, entitled "Isolating Speech Signals Utilizing Neural Networks" filed Mar. 21, 2005; Ser. No. 09/375,309, entitled "Noisy Acoustic Signal Enhancement" filed Aug. 16, 1999; Ser. No. 61/055,651, entitled "Model Based Speech Enhancement," filed May 23, 2008; and Ser. No. 61/055,859, entitled "Speech Enhancement System," filed May 23, 2008, all of these applications are incorporated by reference. In this description, the term about encompasses measurement errors or variances that may be associated with a particular variable.

Figure 6:
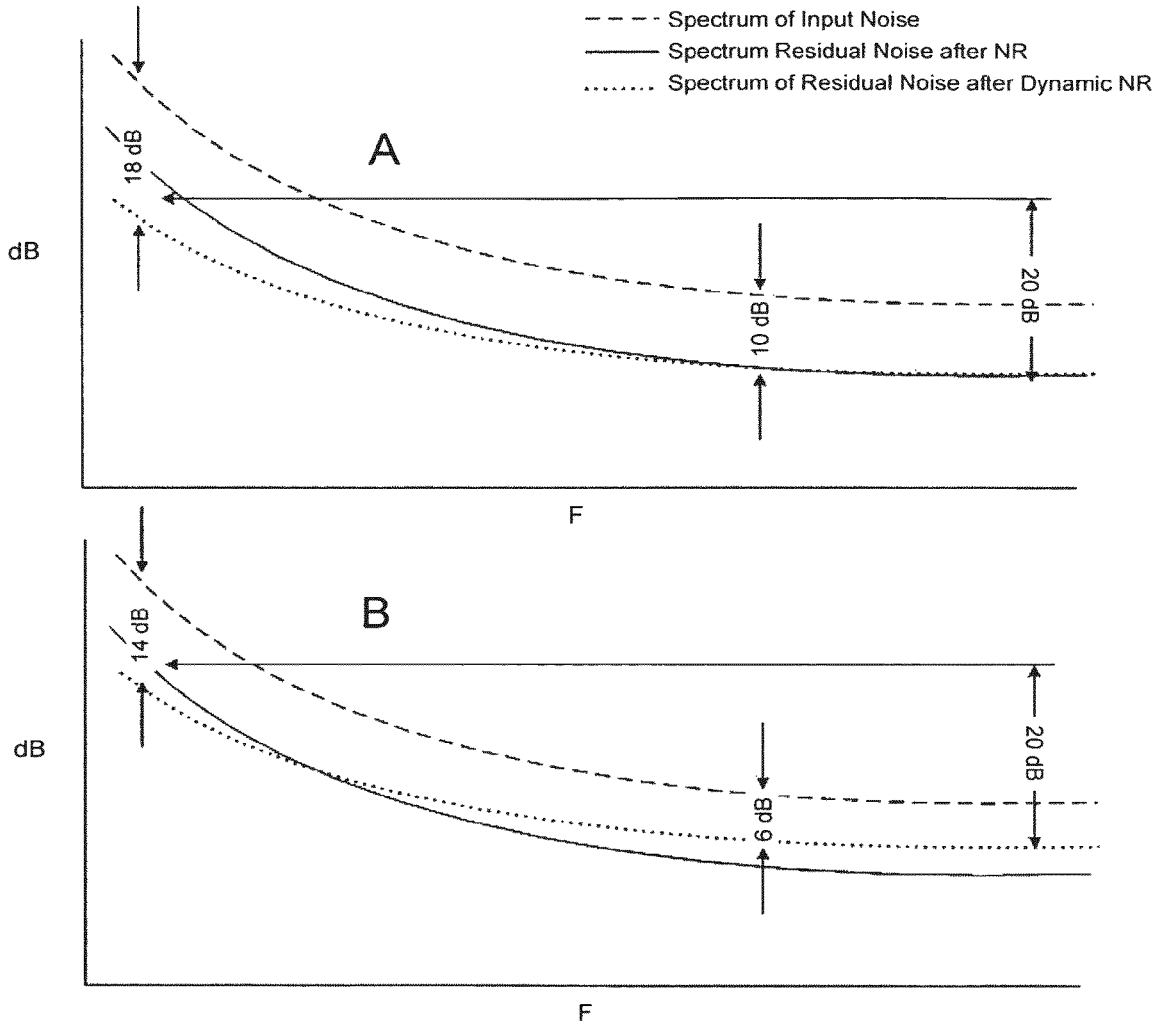
FIG. 6 is an input and output of a speech enhancement system.

FIG. 6 shows the spectrum of noise input to the speech enhancement system (dashed). The solid line represents the residual noise that exists after some nominal amount of noise reduction—in this example about 10 dB across all frequencies. Notice that the spectral tilt resulting rendered after this exemplary noise reduction would violate the assumption of an EVRC causing a gating failure. However, if the spectral tilt were reduced by applying more attenuation at lower frequencies than at higher frequencies (FIG. 6A) then the desired residual noise may be achieved which would minimize or eliminate CDMA gating.

To minimize over-attenuation of low frequency content, the spectral tilt constraint may be met by reducing the amount of attenuation at high frequency ranges as shown in FIG. 6B, thereby applying lower overall noise reduction but still meeting the spectral tilt constraints. Alternatively, the tilt of the incoming noise may be monitored and the output signal maybe dynamically equalized in other alternative systems that include or interface the systems and methods described in Ser. No. 11/167,955, entitled "Systems and Methods for Adaptive Enhancement of Speech Signals," filed Jun. 28, 2005, which is incorporated by reference.

Figure 7:
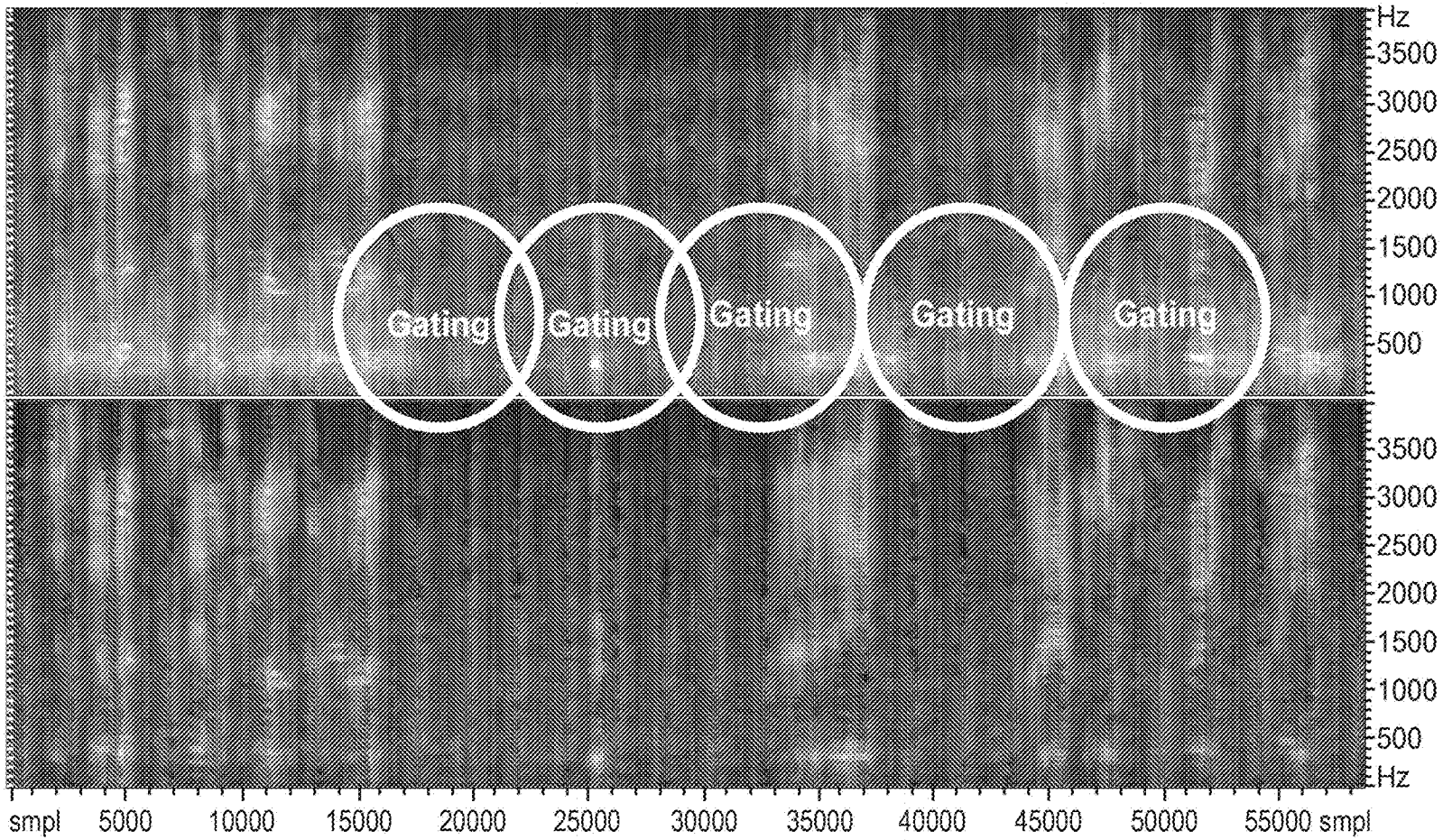
FIG. 7 is an exemplary spectrogram of an output processed with and without a speech enhancement.

FIG. 7 shows a comparison of speech and non-speech segments spoken by a driver of a very noisy sports car that was processed with a recursive Wiener filter prior to being transmitted an exemplary EVRC codec. The top frame of FIG. 7 shows the result of that noisy speech processed through the EVRC codec. The gating that occurs in the speech pauses is highlighted and labeled. Through this channel low speech quality is heard. In the bottom frame of FIG. 7, speech has been processed with a recursive Wiener filter using a dynamic noise floor with constraints applied to the spectral tilt of the residual noise. In the bottom frame there is little or no gating—the noise in the speech segments matches the noise in the lulls between the speeches.

Other alternate systems and methods may include combinations of some or all of the structure and functions described above or shown in one or more or each of the figures. These systems or methods are formed from any combination of structure and function described or illustrated within the figures or incorporated by reference. Some alternative systems are compliant with one or more of the transceiver protocols may communicate with one or more in-vehicle displays, including touch sensitive displays. In-vehicle and out-of-vehicle wireless connectivity between the systems, the vehicle, and one or more wireless networks provide high speed connections that allow users to initiate or complete a communication or a transaction at any time within a stationary or moving vehicle. The wireless connections may provide access to, or transmit, static or dynamic content (live audio or video streams, for example).

The methods and descriptions above may also be encoded in a signal bearing medium, a computer readable medium such as a memory that may comprise unitary or separate logic, programmed within a device such as one or more integrated circuits, or processed by a specialized controller, computer, or an automated speech recognition system. If the disclosure are encompassed in software, the software or logic may reside in a memory resident to or interfaced to one or more specialized processors, controllers, wireless communication interfaces, a wireless system, an entertainment and/or comfort controller of a vehicle or non-volatile or volatile memory. The memory may retain an ordered listing of executable instructions for implementing logical functions.

A logical function may be implemented through digital circuitry, through analog circuitry, or through an analog source such as through an analog electrical, or audio signals. The software may be embodied in a computer-readable medium or signal-bearing medium, for use by, or in connection with an instruction executable system or apparatus resident to a vehicle or a hands-free or wireless communication system. Alternatively, the software may be embodied in media players (including portable media players) and/or recorders. Such a system may include a processor-programmed system that includes an input and output interface that may communicate with an automotive or wireless communication bus through any hardwired or wireless automotive communication protocol, combinations, or other hardwired or wireless communication protocols to a local or remote destination, server, or cluster.

A computer-readable medium, machine-readable medium, propagated-signal medium, and/or signal-bearing medium may comprise any medium that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical or tangible connection having one or more links, a portable magnetic or optical disk, a volatile memory such as a Random Access Memory "RAM" (electronic), a Read-Only Memory "ROM," an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled by a controller, and/or interpreted or otherwise processed. The processed medium may then be stored in a local or remote computer and/or a machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A system, comprising:

a speech enhancement processor configured to receive an input signal and output a processed signal; and an encoder device coupled with the speech enhancement processor and configured to receive the processed signal from the speech enhancement processor, where the encoder device supports one or more spectral shapes to encode the processed signal for transmission over a communication channel;

where the speech enhancement processor is configured to modify a spectral tilt of the input signal, based on a spectral tilt associated with at least one of the one or more spectral shapes supported by the encoder device, to generate the processed signal; and where the speech enhancement processor is configured to modify the spectral tilt of the input signal in response to a determination that an input noise tilt of the input signal surpasses a maximum tilt limitation that is based on one or more spectral shapes available at the encoder device.

2. A system, comprising:

a speech enhancement processor configured to receive an input signal and output a processed signal; and an encoder device coupled with the speech enhancement processor and configured to receive the processed signal from the speech enhancement processor, where the encoder device supports one or more spectral shapes to encode the processor signal for transmission over a communication channel;

where the speech enhancement processor is configured to modify a spectral tilt of the input signal, based on a spectral tilt associated with at least one of the one or more spectral shapes supported by the encoder device, to generate the processed signal;

where the encoder device is configured to perform a comparison between the processed signal that has a modified spectral tilt and a plurality of spectral shapes that represent comfort noise; and where the encoder device is configured to select, based on the comparison, a spectral shape of the plurality of spectral shapes that represent comfort noise for transmission over the communication channel.

3. A system, comprising:

a speech enhancement processor configured to receive an input signal and output a processed signal; and an encoder device coupled with the speech enhancement processor and configured to receive the processed signal from the speech enhancement processor, where the encoder device supports one or more spectral shapes to encode the processed signal for transmission over a communication channel;

where the speech enhancement processor is configured to modify a spectral tilt of the input signal, based on a spectral tilt associated with at least one of the one or more spectral shapes supported by the encoder device, to generate the processed signal; and where the speech enhancement processor is configured to modify the spectral tilt of the input signal by maintaining a suppression gain above a predetermined value.

4. A system, comprising:

a speech enhancement processor configured to receive an input signal and output a processed signal; and an encoder device coupled with the speech enhancement processor and configured to receive the processed signal from the speech enhancement processor, where the encoder device supports one or more spectral shapes to encode the processed signal for transmission over a communication channel;

where the speech enhancement processor is configured to modify a spectral tilt of the input signal, based on a spectral tilt associated with at least one of the one or more spectral shapes supported by the encoder device, to generate the processed signal; and where the speech enhancement processor is configured to modify the spectral tilt of the input signal by generating a suppression gain above a gain floor.

5. A system, comprising:

a speech enhancement processor configured to receive an input signal and output a processed signal; and an encoder device coupled with the speech enhancement processor and configured to receive the processed signal from the speech enhancement processor, where the encoder device supports one or more spectral shapes to encode the processed signal for transmission over a communication channel;

where the speech enhancement processor is configured to modify a spectral tilt of the input signal, based on a spectral tilt associated with at least one of the one or more spectral shapes supported by the encoder device, to generate the processed signal; and where the speech enhancement processor is configured to modify the spectral tilt of the input signal by maintaining a suppression gain above a predetermined value, and where the suppression, gain is based on a cutoff frequency that separates a plurality of frequency ranges.

6. A system, comprising:

a speech enhancement processor configured to receive an input signal and output a processed signal; and an encoder device coupled with the speech enhancement processor and configured to receive the processed signal from the speech enhancement processor, where the encoder device supports one or more spectral shapes to encode the processed signal for transmission over a communication channel;

where the speech enhancement processor is configured to modify a spectral tilt of the input signal, based on a spectral tilt associated with at least one of the one or more spectral shapes supported by the encoder device, to generate the processed signal; and where the speech enhancement processor is configured to apply a different maximum attenuation level in a lower aural frequency band than in a higher aural frequency band.

7. A system, comprising:

a speech enhancement processor configured to receive an input signal and output a processed signal; and an encoder device coin led with the speech enhancement processor and configured to receive the processed signal from the speech enhancement processor, where the encoder device supports one or more spectral shapes to encode the processed signal for transmission over a communication channel;

where the speech enhancement processor is configured to modify a spectral tilt of the input signal, based on a spectral tilt associated with at least one of the one or more spectral shapes supported by the encoder device, to generate the processed signal; and where the speech enhancement processor determines an adaptive noise floor with different maximum attenuation levels for frequency ranges below and above a cutoff frequency.

8. The system of claim 7, where the speech enhancement processor comprises a noise suppressor that applies a dynamic noise suppression constrained by the adaptive noise floor to generate a residual noise spectrum.

9. The system of claim 8, where the noise suppressor is configured to modify the spectral tilt of the input signal by modifying a spectral tilt of the residual noise spectrum, where the noise suppressor is configured to modify the spectral tilt of the residual noise spectrum by applying more noise suppression in a first frequency range than in a second frequency range when the spectral tilt of the residual noise spectrum surpasses a maximum tilt limitation that is based on the at least one of the one or more spectral shapes supported by the encoder device.

10. A speech enhancement system, comprising:

a noise suppression processor coupled with an encoder device that supports one or more spectral shapes, where the noise suppression processor is configured to:

receive an input signal;

generate a processed signal from the input signal by modifying a spectral tilt of the input signal based on a spectral tilt associated with at least one of the one or more spectral shapes supported by the encoder device; and output the processed signal to the encoder device that uses at least one of the one or more spectral shapes to encode the processed signal for transmission over a communication channel;

where the noise suppression processor is configured to modify the spectral tilt of the input signal in response to a determination that an input noise tilt of the input signal surpasses a maximum tilt limitation that is based on one or more spectral shapes available at the encoder device.

11. A speech enhancement system, comprising:

a noise suppression processor coupled with an encoder device that supports one or more spectral shapes, where the noise suppression processor is configured to:

receive an input signal;

generate a processed signal from the input signal by modifying a spectral tilt of the input signal based on a spectral tilt associated with at least one of the one or more spectral shapes supported b the encoder device; and output the processed signal to the encoder device that uses at least one of the one or more spectral shapes to encode the processed signal for transmission over a communication channel; and further comprising the encoder device;

where the encoder device is configured to perform a comparison between the processed signal that has a modified spectral tilt and a plurality of spectral shapes that represent comfort noise; and where the encoder device is configured to select, based on the comparison, a spectral shape of the plurality of spectral shapes that represent comfort noise for transmission over the communication channel.

12. A speech enhancement system, comprising:

a noise suppression processor coupled with an encoder device that supports one or more spectral shapes, where the noise suppression processor is configured to:

receive an input signal;

generate a processed signal from the input signal by modifying a spectral tilt of the input signal based on a spectral tilt associated with at least one of the one or more spectral shapes supported by the encoder device; and output the processed signal to the encoder device that uses at least one of the one or more spectral shapes to encode the processed signal for transmission over a communication channel;

where the noise suppression processor determines an adaptive noise floor with different maximum attenuation levels for frequency ranges below and above a cutoff frequency;

where the noise suppression processor comprises a noise suppressor that applies a dynamic noise suppression constrained by the adaptive noise floor to generate a residual noise spectrum; and where the noise suppressor is configured to modify the spectral tilt of the input signal by modifying a spectral tilt of the residual noise spectrum, where the noise suppressor is configured to modify the spectral tilt of the residual noise spectrum by applying more noise suppression in a first frequency range than in a second frequency range when the spectral tilt of the residual noise spectrum surpasses a maximum tilt limitation that is based on the at least one of the one or more spectral shapes supported by the encoder device.

13. A speech enhancement method, comprising:

receiving an input signal at a speech enhancement processor coupled with an encoder device that supports one or more spectral shapes;

modifying a spectral tilt of the input signal by the speech enhancement processor, based on a spectral tilt associated with at least one of the one or more spectral shapes supported by the encoder device, to generate a processed signal; and outputting the processed signal from the speech enhancement processor to the encoder device that uses at least one of the one or more spectral shapes to encode the processed signal for transmission over a communication channel;

where the step of modifying the spectral tilt of the input signal comprises modifying the spectral tilt of the input signal in response to a determination that an input noise tilt of the input signal surpasses a maximum tilt limitation that is based on one or more spectral shapes available at the encoder device.

14. A speech enhancement method, comprising:

receiving an input signal at a speech enhancement processor coupled with an encoder device that supports one or more spectral shapes;

modifying a spectral tilt of the input signal by the speech enhancement processor, based on a spectral tilt associated with at least one of the one or more spectral shapes supported by the encoder device, to generate a processed signal; and outputting the processed signal from the speech enhancement processor to the encoder device that uses at least one of the one or more spectral shapes to encode the processed signal for transmission over a communication channel;

performing a comparison between the processed signal that has a modified spectral tilt and a plurality of spectral shapes that represent comfort noise; and selecting, based on the comparison, a spectral shape of the plurality of spectral shapes that represent comfort noise for transmission over the communication channel.

15. A speech enhancement method, comprising:

receiving an input signal at a speech enhancement processor coupled with an encoder device that supports one or more spectral shapes;

modifying a spectral tilt of the input signal by the speech enhancement processor, based on a spectral tilt associated with at least one of the one or more spectral shapes supported by the encoder device, to generate a processed signal; and outputting the processed signal from the speech enhancement processor to the encoder device that uses at least one of the one or more spectral shapes to encode the processed signal for transmission over a communication channel;

where the step of modifying the spectral tilt of the input signal comprises generating a suppression gain above a gain floor.

16. A speech enhancement method, comprising:

receiving an input signal at a speech enhancement processor coupled with an encoder device that supports one or more spectral shapes;

modifying a spectral tilt of the input signal by the speech enhancement processor, based on a spectral tilt associated with at least one of the one or more spectral shapes supported by the encoder device, to generate a processed signal; and outputting the processed signal from the speech enhancement processor to the encoder device that uses at least one of the one or more spectral shapes to encode the processed signal for transmission over a communication channel;

where the step of modifying the spectral tilt of the input signal comprises:

determining an adaptive noise floor with different maximum attenuation levels for frequency ranges below and above a cutoff frequency; and applying a dynamic noise suppression constrained by the adaptive noise floor to generate a residual noise spectrum.

17. The speech enhancement method of claim 16, further comprising:

modifying the spectral tilt of the input signal by modifying a spectral tilt of the residual noise spectrum; and modifying the spectral tilt of the residual noise spectrum by applying more noise suppression in a first frequency range than in a second frequency range when the spectral tilt of the residual noise spectrum surpasses a maximum tilt limitation that is based on the at least one of the one or more spectral shapes supported by the encoder device.

* * * * *

UNITED STATES PATENT AND TRADEMARK OFFICE

CERTIFICATE OF CORRECTION

PATENT NO. : 8,930,186 B2
APPLICATION NO. : 13/676463
DATED : January 6, 2015
INVENTOR(S) : Hetherington et al.

It is certified that error appears in the above-identified patent and that said Letters Patent is hereby corrected as shown below:

In the Claims

Column 10, claim 2, line 29, after “encode the” replace “processor” with --processed--.

Column 11, claim 7, line 53, after “encoder device” replace “coin led” with --coupled--.

Column 12, claim 11, line 43, after “shapes supported” replace “b the” with --by the--.

Signed and Sealed this
Nineteenth Day of May, 2015

Michelle K. Lee

Michelle K. Lee
*Director of the United States Patent and Trademark Office*